US010193264B1

(12) United States Patent
Marsden

(10) Patent No.: US 10,193,264 B1
(45) Date of Patent: Jan. 29, 2019

(54) OUTLET COVER

(71) Applicant: Elbee Pty Ltd., Bondi Junction (AU)

(72) Inventor: Andrew Marsden, Hingham, MA (US)

(73) Assignee: Elbee Pty Ltd., Bondi Junction (AU)

( * ) Notice: Subject to any disclaimer, the term of this patent is extended or adjusted under 35 U.S.C. 154(b) by 0 days.

(21) Appl. No.: 15/705,187

(22) Filed: Sep. 14, 2017

(51) Int. Cl.
*H01R 13/443* (2006.01)

(52) U.S. Cl.
CPC ..... *H01R 13/443* (2013.01)

(58) Field of Classification Search
CPC .... H01R 13/44; H01R 13/443; H01R 13/447; H01R 13/453; H01R 13/4532; H01R 13/4538; A61L 9/03
See application file for complete search history.

(56) References Cited

U.S. PATENT DOCUMENTS

| | | | | |
|---|---|---|---|---|
| D28,471 | S | 4/1898 | Newton | |
| D118,894 | S | 2/1940 | Williams | |
| D118,923 | S | 2/1940 | Williams | |
| D118,924 | S | 2/1940 | Williams | |
| D151,571 | S | 10/1948 | Tillinghast | |
| D155,174 | S | 9/1949 | Martin | |
| D189,452 | S | 12/1960 | Bellek | |
| D222,262 | S | 10/1971 | Hartford | |
| 3,686,616 | A * | 8/1972 | Bowerman | H01R 13/443 24/511 |
| 4,293,173 | A | 10/1981 | Tricca | |
| 4,760,215 | A * | 7/1988 | Cook | H02G 3/14 174/67 |
| 4,801,271 | A * | 1/1989 | Piper | H01R 13/443 174/67 |
| 5,017,148 | A | 5/1991 | Buckshaw | |

(Continued)

FOREIGN PATENT DOCUMENTS

KR 20-0453491 5/2011

OTHER PUBLICATIONS

[No Author Listed] 10 Pcs Adjustable Handle Baby Anti-Shock Safety Socket Safety Cover Power Outlet Pretective Cover 2—Hole 3—Phase. Aliexpress.com. https://www.aliexpress.com/item/10-pcs-Adjustable-handle-baby-anti-shock-safety-socket-safety-cover-power-outlet-protective-cover-2/32784555605.html?spm=2114.search0301.4.159.KRtA0q, 11 pages [printed Sep. 29, 2017] Publicly disclosed prior to Sep. 14, 2017.

(Continued)

*Primary Examiner* — Edwin A. Leon
*Assistant Examiner* — Oscar Jimenez
(74) *Attorney, Agent, or Firm* — Wolf, Greenfield & Sacks, P.C.

(57) ABSTRACT

A electrical outlet cover has prongs, a cover plate, and a grasping arm that is pivotable between a closed position and an open position. In the closed position, the arm is flush with the cover plate. In the open position, the grasping arm extends from the outlet cover and is used to pull the outlet cover out of the outlet. The grasping arm may be curved. To release one end of the grasping arm so that the arm can be pivoted to the open position, a user presses on the arm to straighten the curved arm. The straightening of the arm disengages a free end of the arm from the cover plate and permits pivoting. In embodiments where the pivotable attachment of the arm to the cover plate is spaced vertically higher or lower than the prongs, the cover plate may rotate slightly as the grasping arm is pulled.

24 Claims, 11 Drawing Sheets

(56) References Cited

U.S. PATENT DOCUMENTS

| | | | | |
|---|---|---|---|---|
| 5,080,599 | A * | 1/1992 | Wimberly | H01R 13/443 174/67 |
| 5,096,430 | A * | 3/1992 | D'Amico | H01R 13/443 174/67 |
| 5,320,542 | A * | 6/1994 | Cheng | H01R 13/443 174/67 |
| D359,270 | S | 6/1995 | Connelly | |
| D361,056 | S | 8/1995 | Barry | |
| D383,727 | S | 9/1997 | Caruso et al. | |
| 5,704,796 | A * | 1/1998 | Swenson | H01R 13/443 439/148 |
| 5,800,188 | A * | 9/1998 | Barber | B60D 1/64 220/242 |
| 5,945,094 | A * | 8/1999 | Martin | A61L 9/037 219/392 |
| 6,699,050 | B1 * | 3/2004 | Wong | H01R 13/443 174/67 |
| 6,703,562 | B1 * | 3/2004 | Pacheco | H02G 3/14 174/66 |
| 6,832,921 | B1 * | 12/2004 | Stewart | H01R 13/447 174/66 |
| 8,093,497 | B2 * | 1/2012 | White | H02G 3/14 174/66 |
| 9,570,833 | B2 * | 2/2017 | Kloosterboer | H01R 13/447 |
| 2001/0051460 | A1 | 12/2001 | Ota et al. | |
| 2003/0143880 | A1 * | 7/2003 | Bousquet | H01R 13/5213 439/135 |

OTHER PUBLICATIONS

[No Author Listed] Safety 1st Press 'n Pull Plug Protectors 24 Pack. Amazon.com. https://www.amazon.com/Safety-1st-Press-Pull-Protectors/dp/B0017ZCM3A, 2 pages [printed Sep. 29, 2017] Publicly disclosed prior to Sep. 14, 2017.

* cited by examiner

OUTLET COVER

FIELD

Embodiments disclosed herein relate to electrical outlet safety covers.

DISCUSSION OF THE RELATED ART

Those who care for young children may wish to add an outlet cover to their electrical outlets to reduce the chance of an electrical shock. Known outlet covers include cover plates with prongs that fit into outlet holes. These outlet covers sit substantially flush with the outlet and typically are removed by using fingernails or an instrument to pull the outlet away from the outlet.

SUMMARY

According to one embodiment, an electrical outlet cover includes a cover plate with a first engagement member and a plurality of prongs that are insertable into contact holes of electrical outlets and extend from the cover plate. The outlet cover further includes a grasping arm which is pivotably attached to the cover plate and moveable between a closed position and an open, grasping position. The grasping arm has a second engagement member. In the closed position, the second engagement member engages the first engagement member to prevent pivoting of the grasping arm out of the closed position. The grasping arm is resiliently deformable to a deformed state in which the first engagement member disengages from the second engagement member, and allows the grasping arm to pivot to the open position.

According to another embodiment, an electrical outlet cover includes a cover plate that has a first engagement member, and a plurality of prongs that are insertable into the contact hole of an electrical outlet and extend from the cover plate. The outlet cover additionally includes a grasping arm which is pivotably attached to the cover plate and is moveable between a closed position, and an open, grasping position. The grasping arm has a second engagement member. In the closed position, the second engagement member engages the first engagement member to prevent pivoting of the gasping arm. The grasping arm is attached to the cover plate with a hinged connection at a first edge of the cover plate. The first engagement member on the graspable arm is positioned at a second, opposite edge of the cover plate.

According to a further embodiment, a method for removing an outlet cover from an outlet is provided. The outlet cover includes a curved pivot arm pivotably attached to a cover plate and releasably engageable with the cover plate. The method includes resiliently deforming the pivot arm causing the pivot arm to disengage from the cover plate, and applying a force on an end of the pivot arm to pivot the end of the pivot arm away from the cover plate such that the pivot arm protrudes outwardly from the outlet cover. The method also includes grasping the pivot arm and applying a pulling force on the cover plate in a direction away from the outlet.

DETAILED DESCRIPTION

Figure 1:
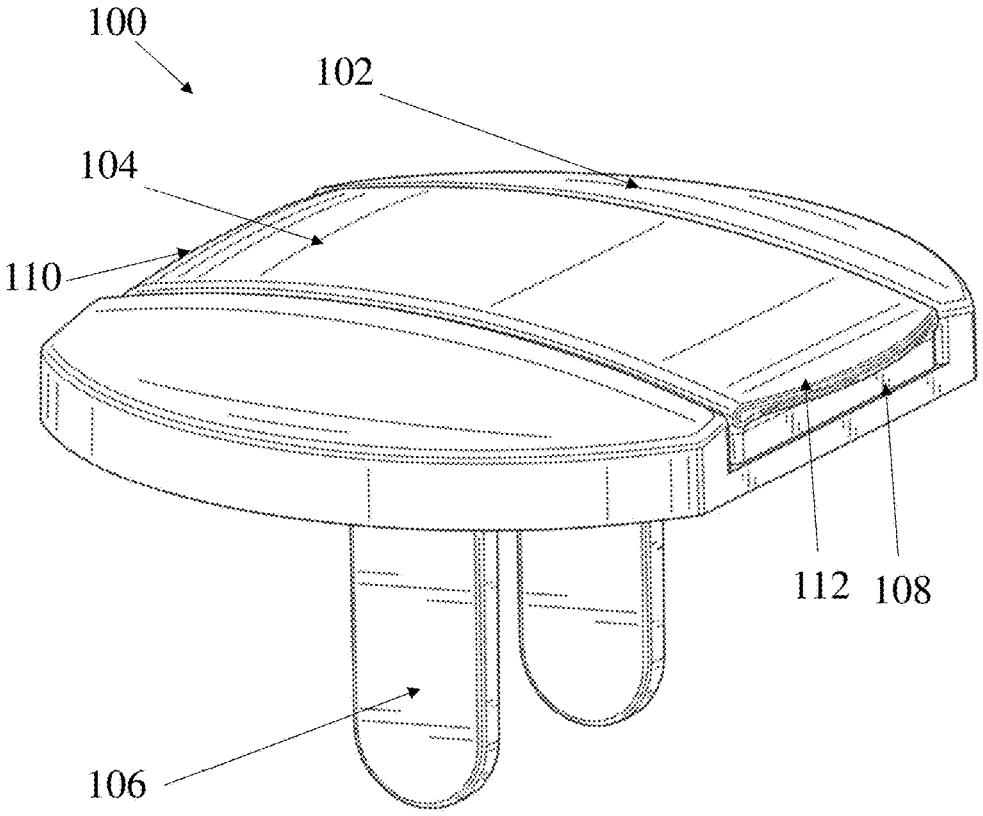
FIG. 1 is a left side perspective view of the outlet cover according to one embodiment, in the closed configuration.

It should be understood that aspects are described herein with reference to certain illustrative embodiments and the figures. The illustrative embodiments described herein are not necessarily intended to show all aspects, but rather are used to describe a few illustrative embodiments. Thus, aspects are not intended to be construed narrowly in view of the illustrative embodiments. In addition, it should be understood that certain features disclosed herein might be used alone or in any suitable combination with other features.

Outlet covers are a common arrangement used to prevent young children from accessing electrical outlets. As is well known in the art, outlet covers typically include a cover plate which serves as a primary blocking element, and prongs that extend from the cover plate for insertion into the outlet holes. The prongs are typically sized such that a reasonable amount of force is required to remove the prongs from the outlet. These outlet covers tend to sit flush with the wall; pulling the outlet cover out of the outlet can be difficult for an adult. Other outlet covers require tools for insertion and/or removal, which can be inconvenient in some circumstances.

Disclosed herein are outlet covers which are sufficiently difficult to remove such that a child would be discouraged, but convenient for an adult to insert and remove. According to one embodiment, an outlet cover includes a grasping arm pivotally attached to one side of a cover plate. The grasping arm may be positionable within a channel in the cover plate such that the grasping arm sits flush with the plate and maintains a low profile to not attract attention. A free end of the grasping arm may have an engagement element such as a protrusion that engages with a complementary recess in the cover plate to secure the grasping arm to the cover plate. The grasping arm may be curved outwardly from the cover plate such that deforming the arm inwardly toward the cover plate causes the protrusion to disengage from the recess, thereby releasing the grasping arm. A user can then rotate the grasping arm by pulling on the free end such that the grasping arm extends outwardly from the cover plate. In this open configuration, the user can pull the grasping arm outwardly from the outlet to remove the outlet cover from the outlet without needing a separate tool, or needing to access an underside of the outlet cover.

In some embodiments, by having the grasping arm attached at an edge of the cover plate, the user's pulling force slightly rotates the cover plate and may result in a lever action. For example, with the grasping arm pivotably attached at a top edge of the cover plate, pulling on the grasping arm may slightly rotate the cover plate about a bottom edge of the plate such that the bottom edge presses against the outlet and acts as a fulcrum for a second order lever. By applying a pulling force on the cover plate at a location that is vertically higher than the prongs, a mechanical advantage may be used to pull the prongs from the outlet holes. In some embodiments, the grasping arm may be attached at a lower edge such that a pulling force is applied at a vertically lower location on the cover plate as compared to the prongs.

Turning now to the figures, several non-limiting embodiments are described in further detail. It should be understood that the various features and components described with reference to the figures may be arranged in any suitable combination and that the current disclosure is not limited to only those embodiments depicted in the figures.

FIG. 1 shows a left side perspective view of one embodiment of an outlet cover 100. Cover plate 102 forms the bulk of the body of the outlet cover 100, and has prongs 106 extending from its outlet-facing side. Grasping arm 104, shown here in a closed configuration, sits flush with cover plate 102. In this embodiment, grasping arm 104 runs along the center of cover plate 102 from a hinged end 110 on one side of the cover plate to a free end 112 on the opposite side. The free end 112 includes a hook 108 that secures the grasping arm to the cover plate as will be described in detail below.

In some embodiments, grasping arm 104 runs horizontally across the cover plate in line with the prongs. The grasping arm may run along the cover plate off-center (but linearly), or diagonally, or may terminate prior to the end of the cover plate. Embodiments may include multiple grasping arms or a grasping arm that covers the entire face of the cover plate.

The illustrated embodiment of cover plate 102 has two linear sides and two curved sides, but any suitable shape (symmetric or freeform) may be used.

Figure 2:
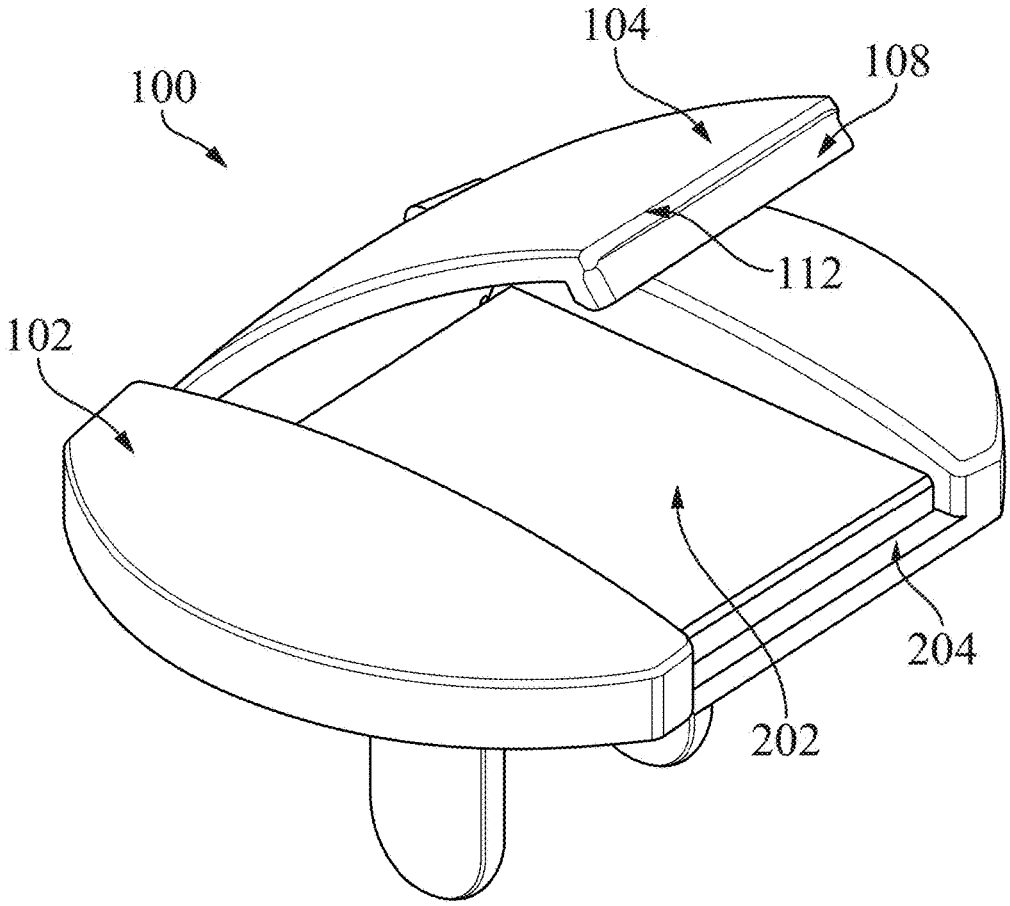
FIG. 2 is a left side perspective view of the outlet cover of FIG. 1 in the open configuration.
Figure 3:
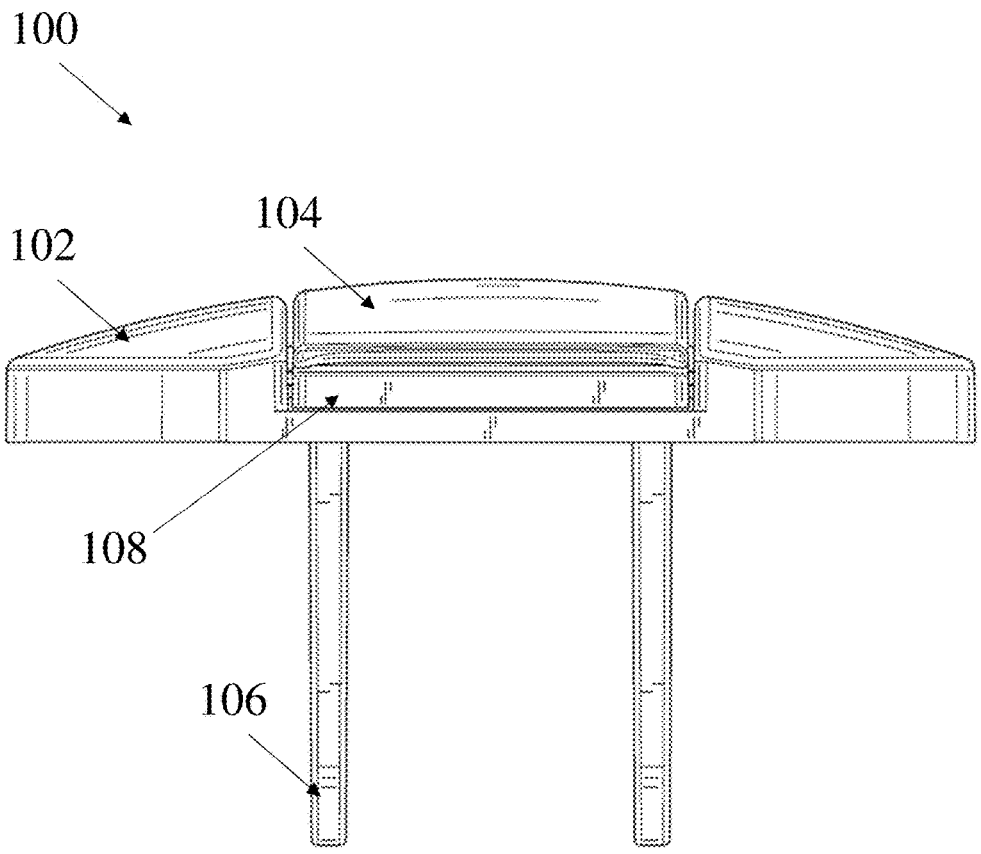
FIG. 3 is a front view of the outlet cover of FIG. 1 in the closed configuration.
Figure 4:
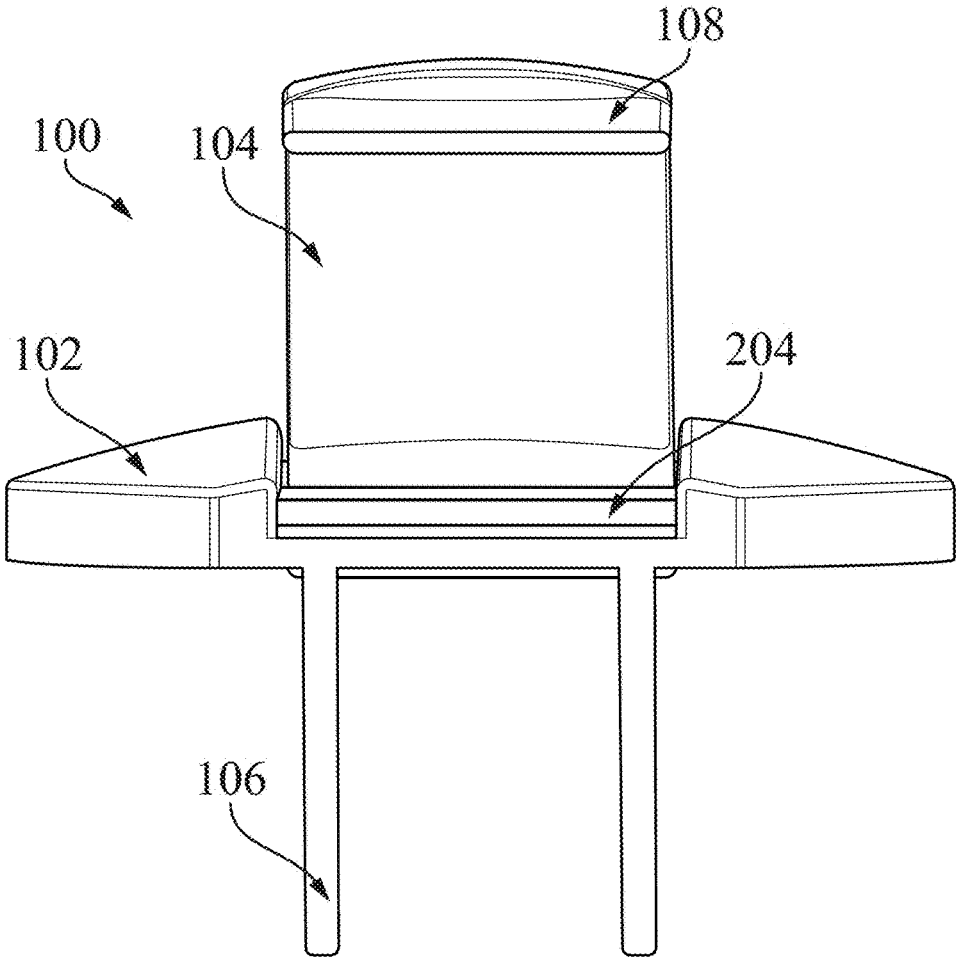
FIG. 4 is a front view of the outlet cover of FIG. 1 in the open configuration.
Figure 5:
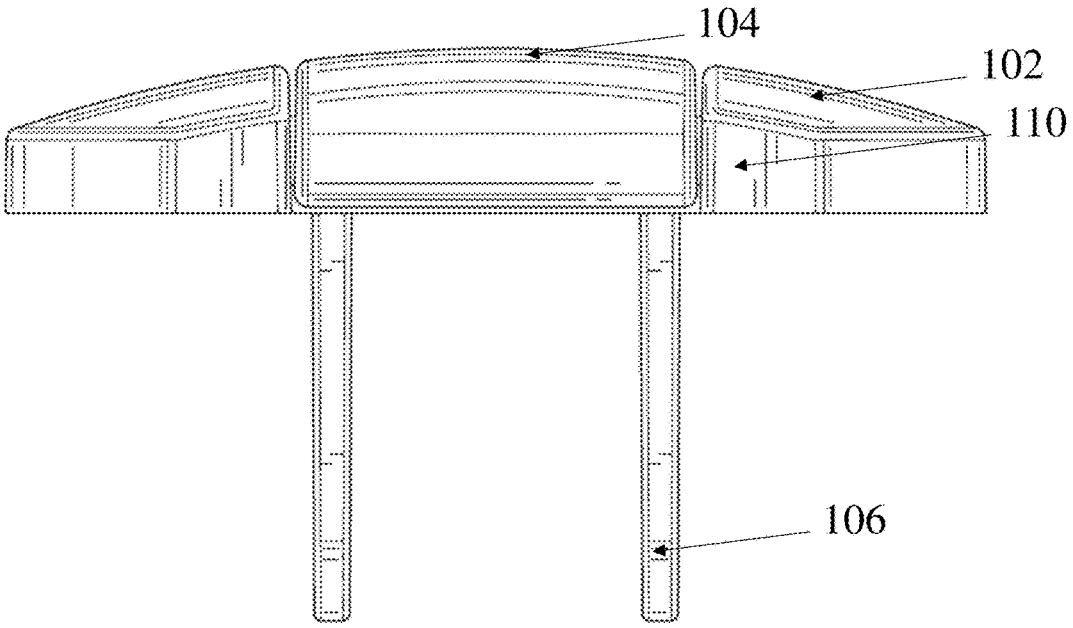
FIG. 5 is a rear view of the outlet cover of FIG. 1 in the closed configuration.
Figure 6:
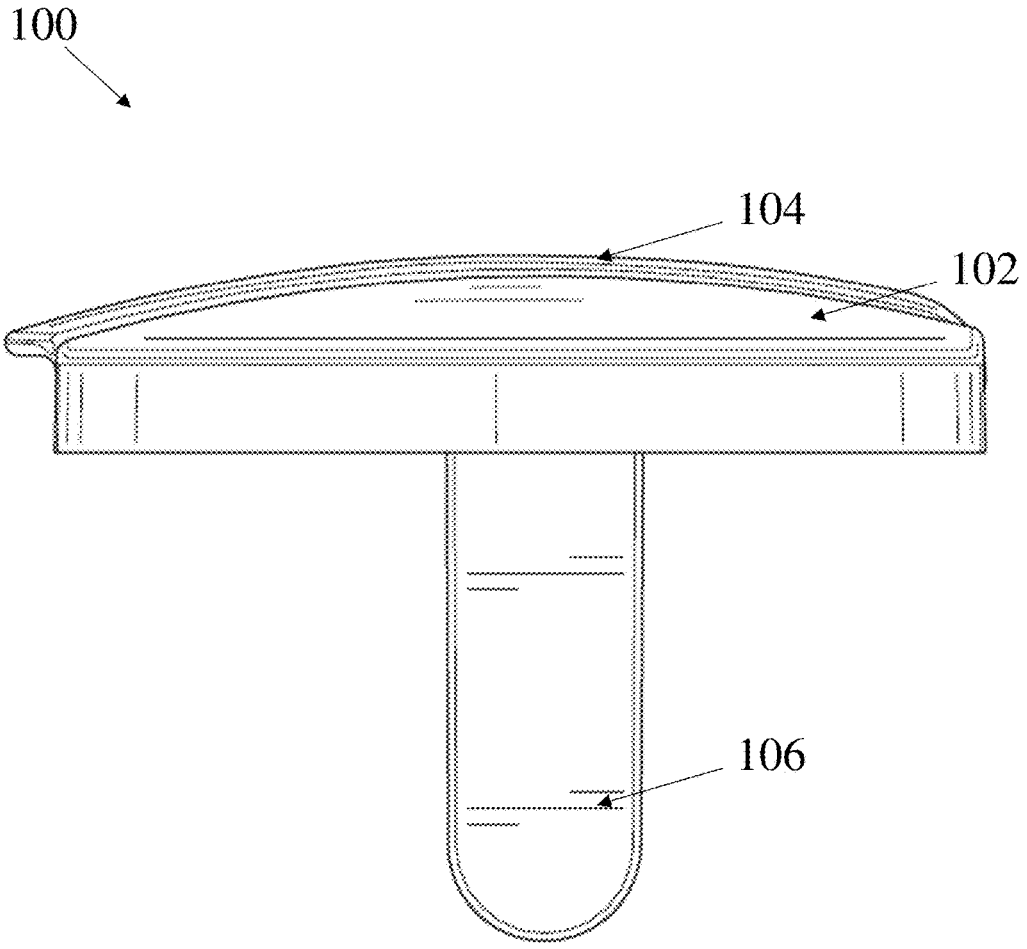
FIG. 6 is a bottom view of the outlet cover of FIG. 1 in the closed configuration.

FIGS. 2 and 4 show outlet cover 100 in an open position, while FIGS. 3, 5 and 6 show the cover in a closed position. In this embodiment, cover plate 102 includes a channel 202 within which grasping arm 104 sits when in the closed position. Hook 108 engages with complementary recess 204 set in the non-hinged side of cover plate 102 to keep grasping arm 104 secured to the cover plate. As shown in the figures, grasping arm 104 may be curved outwardly away from the cover plate. Cover plate 102 is similarly curved along its non-outlet facing surface such that grasping arm 104 is flush with the non-outlet facing surface in the closed configuration seen in FIG. 1. In other embodiments, grasping arm 104 may not be flush with the outer surface of cover plate 102.

Because of the curved shape of grasping arm 104, pressing on the curve of the grasping arm and deforming the arm against the curve and towards the cover plate straightens the grasping arm 104. This causes free end 112 to extend away from cover plate 102 such that hook 108 disengages from recess 204. A user may then pull free end 112 away from cover plate 102 to rotate that grasping arm 104 to the open state. With the grasping arm 104 extending from cover plate 102, a user can pull the arm outwardly from to the outlet to remove the outlet cover 100 from the outlet. The underside of grasping arm 104 may include a surface treatment designed to increase friction and facilitate its functionality as a handle by making it easier to grip.

By having a single discrete arm in some embodiments, the outlet cover 100 does not present an arrangement within which a child could get a finger caught in. A single grasping arm arrangement with a single pivoting connection may be simpler to manufacture and assemble in some embodiments than a more complex arrangement as well. However, in some embodiments of the present disclosure, a loop-type grasping arm may be used where the loop is hinged at opposing sides of the cover plate, or simply in two or more places on the cover plate.

The above-described embodiment uses a hook and a complementary recess, but in other embodiments, other engagement members may be used. For example, the engagement member may be a claw, a surface coated in adhesive, a magnetic strip, or any other arrangement that suitably forms a removable attachment with a complementary engagement member. Similarly, the complementary engagement member in other embodiments may be any blocking surface that engages with the hook, for example a tab or other protrusion.

This method of disengaging the hook (or other engagement feature on the grasping arm) from the complementary engagement feature on the cover plate may reduce wear and tear on the engagement mechanisms as compared to other arrangements. For example, some engagement mechanisms rely on a flexible protrusion to prevent movement. When sufficient force is applied, the protrusion bends slightly and is able to pass by a complementary blocking surface. Over time, the resiliency of the protrusion or the structural integrity of the blocking surface may be compromised. With the embodiment described above where the curved grasping arm is extended through deformation, the hook 108 clears a complementary blocking surface of the recess 204 without any bending of the hook or blocking surface. Though it is important to note that in some embodiments of the present disclosure, a flexible protrusion arrangement may be used in combination with other aspects disclosed herein.

While grasping arm 104 is shown to curve outwardly away from cover plate 102, in some embodiments grasping arm 104 curves inwardly toward cover plate 102 instead. In these embodiments, grasping arm 104 may include a pulling member on its top surface such that a user can pull on the pulling member to deform and straighten a grasping arm to disengage a hook or other engagement member from complementary engagement member on the cover plate. In still further embodiments, the grasping arm may not be curved toward or away from the cover plate.

Figure 7:
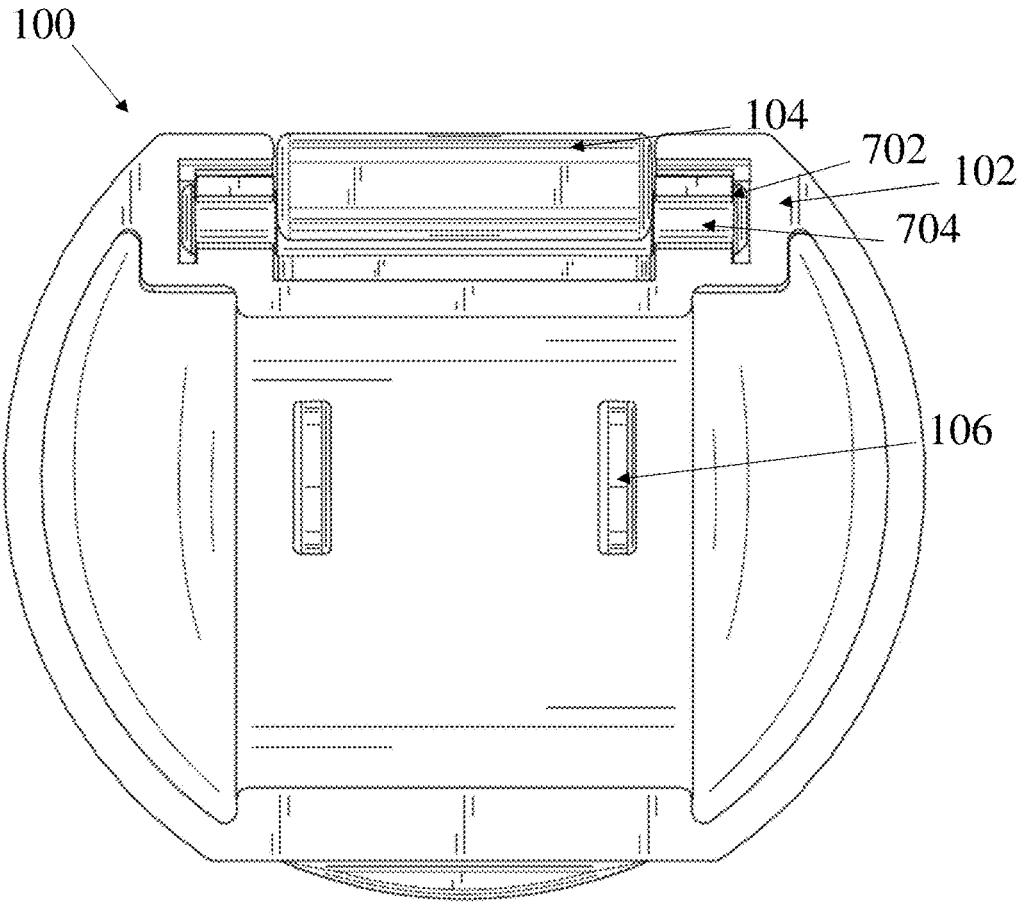
FIG. 7 is a right side view of the outlet cover of FIG. 1 in the closed configuration.
Figure 8:
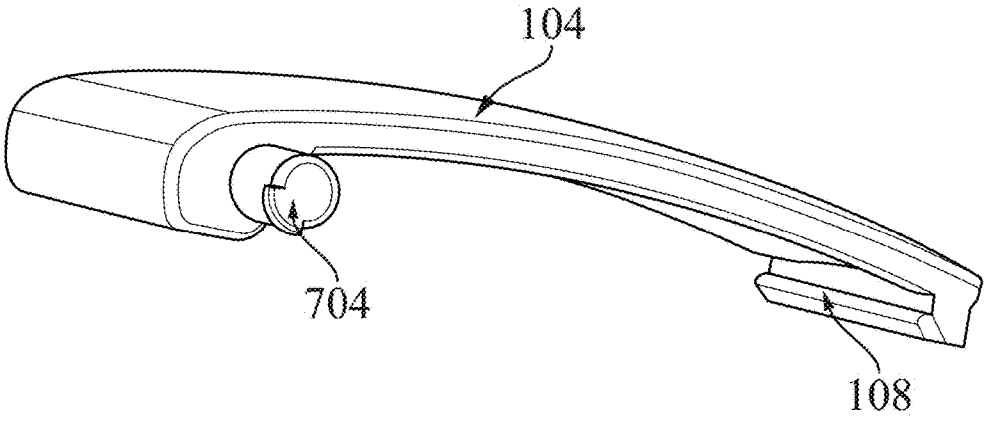
FIG. 8 is a left side perspective view of the grasping arm according to one embodiment of the outlet cover.
Figure 9:
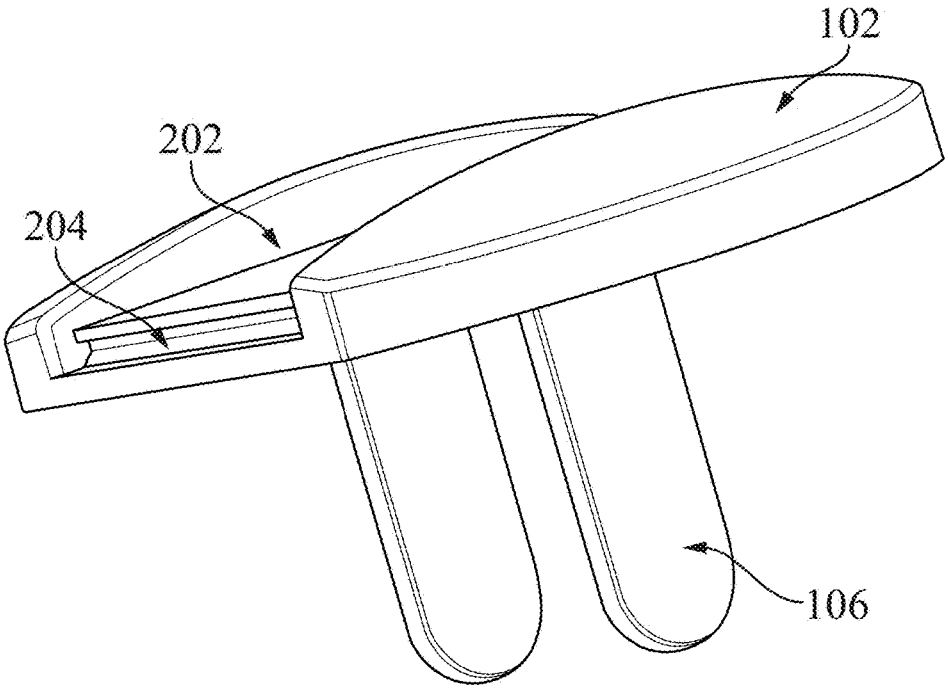
FIG. 9 is a right side perspective view of the cover plate and prongs according to one embodiment of the outlet cover.

The hinged attachment of grasping arm 104 to cover plate 102 is visible in the bottom view of FIG. 7. As seen in FIG. 8, the hinged end 110 of grasping arm 104 has protrusions 704 extending from either lateral side of the grasping arm 104. During assembly, protrusions 704 are received and held within recesses 702, which are formed in the outlet-facing side of cover plate 102. This arrangement allows grasping arm 104 to rotate relative to cover plate 102 about the axis formed by the two protrusions 704, which together with recesses 702 act as a hinge. The protrusions may be snapped into the recesses in some embodiments. Cylindrical protrusions and recesses are used in the illustrated embodiment to form a hinge joint, though other arrangements and joints may be used. The protrusions may be snapped into the recesses in some embodiments.

Other methods of pivotably attaching grasping arm 104 to cover plate 102 are contemplated for other embodiments. In some embodiments, the cover plate and graspable arm are each secured to either end of a traditional hinge plate, where the rod of the hinge is located at the hinged side of cover plate 102, and not recessed in the cover plate. In still other embodiments, cover plate 102 includes an entire rod recessed within the bottom surface. In these embodiments, graspable arm 104 may have a plurality of claws at hinged end 110 that grip the rod such that the graspable arm 104 can freely rotate about the rod. Other hinge mechanisms are also contemplated, and the current disclosure is not limited to the above-described embodiments.

Figure 10:
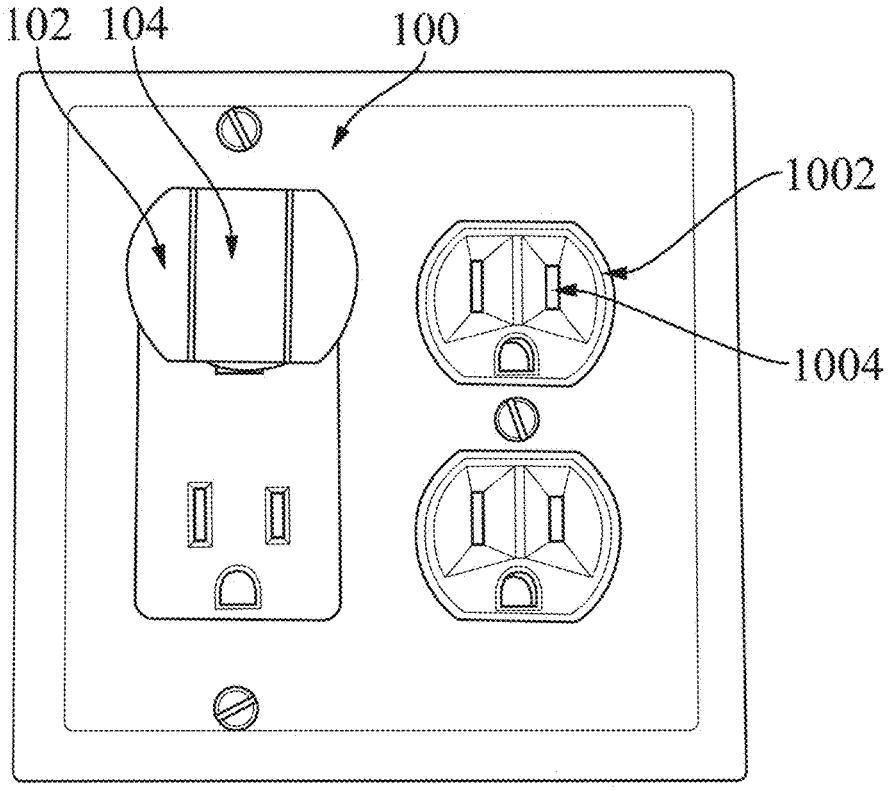
FIG. 10 is a front view of the outlet cover in the closed position, according to one embodiment, in use within a standard electrical outlet.
Figure 11:
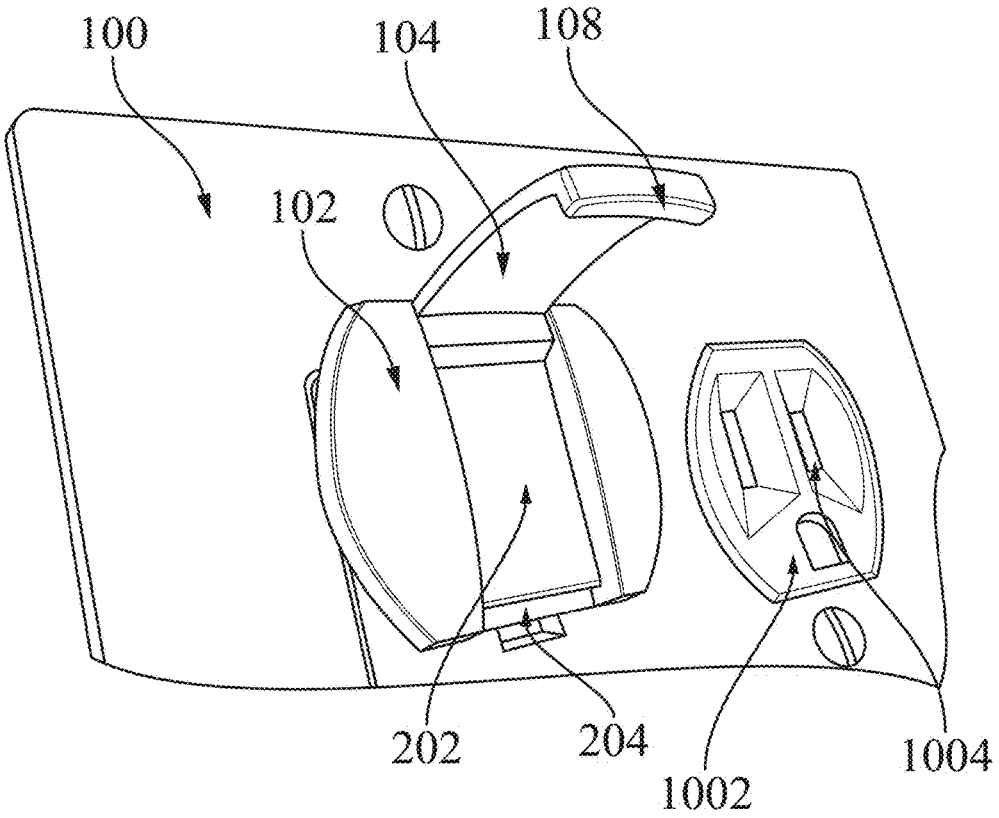
FIG. 11 is a left side perspective view of the outlet cover of FIG. 10 in the open configuration, in use within a standard electrical outlet.

FIGS. 10 and 11 show outlet cover 100 inserted in an outlet. Employing outlet cover 100 simply includes inserting prongs 106 into outlet holes 1004 such that cover plate 102 blocks outlet 1002. Most countries standardize the size and configurations of outlet holes 1004, and different embodiments of outlet cover 100 have prongs 106 sized and arranged to fit tightly within various outlets. When grasping arm 104 is in its open configuration and extending from cover plate 102, for example as shown in FIG. 11, the arm can be gripped by a user to pull the cover out of the outlet. By having the grasping arm attached at an edge of the cover plate, in some embodiments, the user's pulling force rotates the cover plate slightly about a bottom edge of the plate, such that the bottom edge presses on the outlet and becomes the fulcrum of a second order lever. Thus, a mechanical advantage is used to pull the prongs from the outlet holes and remove the outlet cover.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. An electrical outlet cover comprising: a cover plate having an electric outlet-facing side, an outwardly-facing side, and a first engagement member; a plurality of prongs extending from the electric outlet-facing side of the cover plate and insertable into contact holes of an electrical outlet; and a grasping arm disposed on the outwardly-facing side of the cover plate when the grasping arm is in a closed position, and pivotably moveable between the closed position and an open, grasping position, the grasping arm having a second engagement member; wherein in the closed position, the second engagement member engages the first engagement member to prevent pivoting of the grasping arm out of the closed position; the grasping arm is resiliently deformable to a deformed state in which the first engagement member disengages from the second engagement member to allow the grasping arm to pivot to the open position; and the second engagement member is re-engageable with the first engagement member after the grasping arm has been in the open position to prevent pivoting of the grasping arm out of the closed position.

2. The outlet cover of claim 1, wherein the cover plate includes a blocking surface, and the second engagement member of the grasping arm includes a protrusion which engages the blocking surface on the cover plate.

3. The outlet cover of claim 2, wherein the grasping arm extends along a lateral center of the cover plate, and the grasping arm is attached at a first end of the cover plate and the second engagement member is positioned at a second end of the cover plate.

4. The outlet cover of claim 2, wherein the blocking surface is part of a recess on the cover plate.

5. The outlet cover of claim 1, wherein the grasping arm is constructed and arranged such that in the closed position, pushing the grasping arm bends the grasping arm and disengages the second engagement member of the grasping arm from the first engagement member of the cover plate.

6. The outlet cover of claim 5, wherein:

the grasping arm is attached to the cover plate at a pivot location;

in the closed position, the grasping arm is curved outwardly away from the prongs, and the first engagement member is spaced a first distance from the pivot location; and the grasping arm is adapted such that pushing the grasping arm toward the cover plate reduces the curvature of the grasping arm and moves the first engagement member such that the first engagement member is spaced a second distance from the pivot location, the second distance being greater than the first distance, wherein at the second distance, the first engagement member disengages from the second engagement member.

7. The outlet cover of claim 1, wherein when the grasping arm is in the closed position, an outer surface of the grasping arm is flush with the outwardly-facing side of the cover plate.

8. The outlet cover of claim 1, wherein the grasping arm is pivotably attached to the cover plate at a first edge of the cover plate, and the first engagement member of the cover plate is positioned at an opposite edge of the cover plate.

9. The outlet cover of claim 1, wherein the grasping arm is pivotably attached along only one edge of the outlet cover.

10. The outlet cover of claim 1, wherein the grasping arm is disposed in a channel on the outwardly-facing side of the cover plate when in the closed position.

11. An electrical outlet cover comprising: a cover plate having an electric outlet-facing side, an outwardly-facing side, and a first engagement member; a plurality of prongs extending from the electric outlet-facing side of the cover plate and insertable into contact holes of an electrical outlet; and a grasping arm disposed on the outwardly-facing side of the cover plate when the grasping arm is in a closed position, and pivotably moveable between the closed position and an open, grasping position, the grasping arm having a second engagement member; wherein in the closed position, the second engagement member engages the first engagement member to prevent pivoting of the grasping arm out of the closed position; the grasping arm is pivotably attached to the cover plate at a first edge of the cover plate, and the first engagement member of the cover plate is positioned at a second, opposite edge of the cover plate; and after being in the open, grasping position, the second engagement member is engageable with the first engagement member to prevent pivoting of the grasping arm out of the closed position.

12. The outlet cover of claim 11, wherein the second engagement member includes a hook, and the first engagement member includes a complementary recess.

13. The outlet cover of claim 11, wherein the second engagement member includes a protrusion, and the first engagement member includes a blocking surface.

14. The outlet cover of claim 11, wherein the graspable grasping arm is curved such that an apex of the curve extends away from the cover plate.

15. The outlet cover of claim 11, wherein the grasping arm is resiliently deformable such that pressing on the grasping arm disengages the second engagement member from the first engagement member and allows the grasping arm to be pivoted to the open position.

16. The outlet cover of claim 15, wherein the grasping arm is resiliently deformable such that pressing on the grasping arm straightens a curved portion of the grasping arm and disengages the second engagement member from the first engagement member.

17. The outlet cover of claim 16, wherein straightening of the grasping arm disengages a hook from the complementary blocking surface.

18. The outlet cover of claim 11, wherein an outer surface of the grasping arm, when in the closed position, is flush with the outwardly-facing side of the cover plate.

19. The outlet cover of claim 11, wherein the grasping arm extends along a lateral center of the cover plate.

20. The outlet cover of claim 11, wherein the grasping arm is disposed in a channel on the outwardly-facing side of the cover plate when in the closed position.

21. A method of using an outlet cover with an outlet, the outlet cover including prongs and a curved pivot arm pivotably attached to a cover plate at a pivot location, the curved pivot arm being releasably engageable with the cover plate at an engagement location spaced from the pivot location, the method comprising: resiliently deforming the pivot arm causing the pivot arm to disengage from the cover plate at the engagement location; applying a force on an end of the pivot arm to pivot the end of the pivot arm away from the cover plate such that pivot arm protrudes outwardly from the outlet cover; grasping the pivot arm and applying a pulling force to the cover plate in a direction away from the outlet to remove the prongs from the outlet; after removing the prongs from the outlet, inserting the prongs into the outlet; and pivoting the pivot arm until the pivot arm re-engages with the cover plate at the engagement location.

22. The method of claim 21, wherein deforming the curved pivot arm causes a hook at the end of the pivot arm to disengage from a complementary blocking surface of the outlet cover.

23. The method of claim 21, wherein applying a pulling force to the outlet cover comprises applying a pulling force at a location vertically higher than the prongs such that the cover plate rotates slightly while the prongs are being removed from the outlet.

24. The method of claim 21, wherein applying a pulling force to the outlet cover comprises applying a pulling force at a location vertically lower than the prongs such that the cover plate rotates slightly while the prongs are being removed from the outlet.

* * * * *